United States Patent [19]

Vargas

[11] 3,957,110

[45] May 18, 1976

[54] CONTINUOUS PROCESS DRYER

[76] Inventor: Arnaldo Rubini Vargas, Ricardo Palma 869 (Dpto. 402), Lima 18, Peru

[22] Filed: Jan. 16, 1975

[21] Appl. No.: 541,441

[52] U.S. Cl. ..... 165/94; 165/109; 259/3

[51] Int. Cl.[2] ..... F28G 3/10

[58] Field of Search ..... 62/354; 165/94, 95, 165/109; 34/108, 119, 121, 124, 128, 141, 142, 85, 178; 259/DIG. 18, 3

[56] References Cited

UNITED STATES PATENTS 3,206,287 9/1965 Crawford ..... 165/94

*Primary Examiner*—Charles J. Myhre
*Assistant Examiner*—Theophil W. Streule, Jr.
*Attorney, Agent, or Firm*—Richard W. Hanes

[57] ABSTRACT

A heat transfer system for particulant material in which high or low temperature fluid carrying conduits are disposed in a trough into which the material to be treated is placed. A group of mixing paddles are driven along the trough which mixes and stirs the material and scrapes the material from the conduits. At the point where the conduits enter and exit the trough, the paddles are rotated by a cam follower arrangement to a profile position between the conduits and the conduits and trough sides. While in the profile position, the paddles pass through narrow slots in a stationary cleaning scrapper. Material is overhead fed into the trough and discharged from an opening in the bottom thereof after the material has made one pass along the length of conduits in the trough, having been carried along the trough by the raking action of the paddles.

8 Claims, 5 Drawing Figures

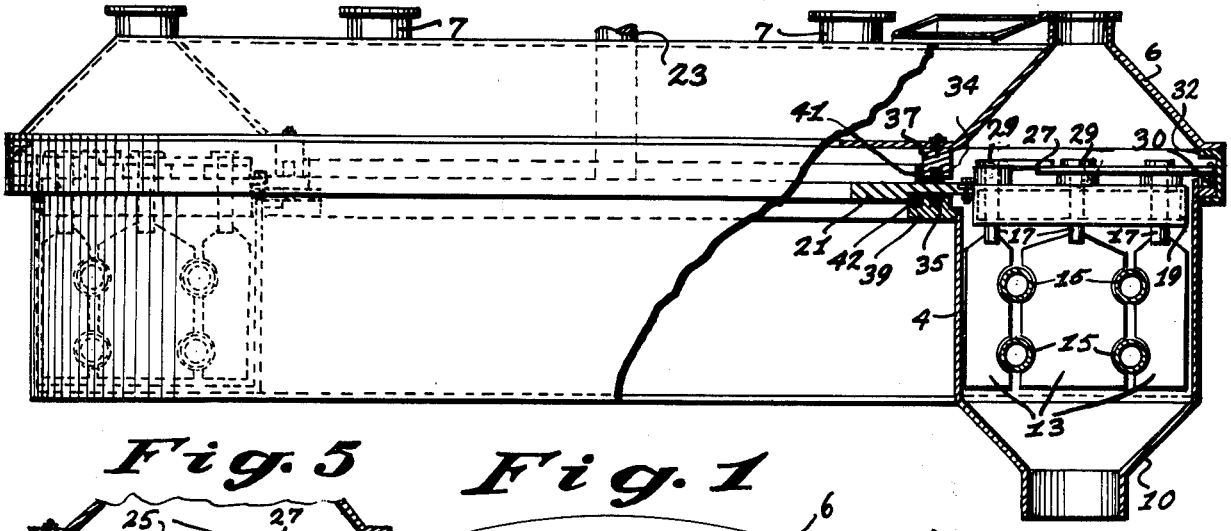
Fig. 5
Fig. 1
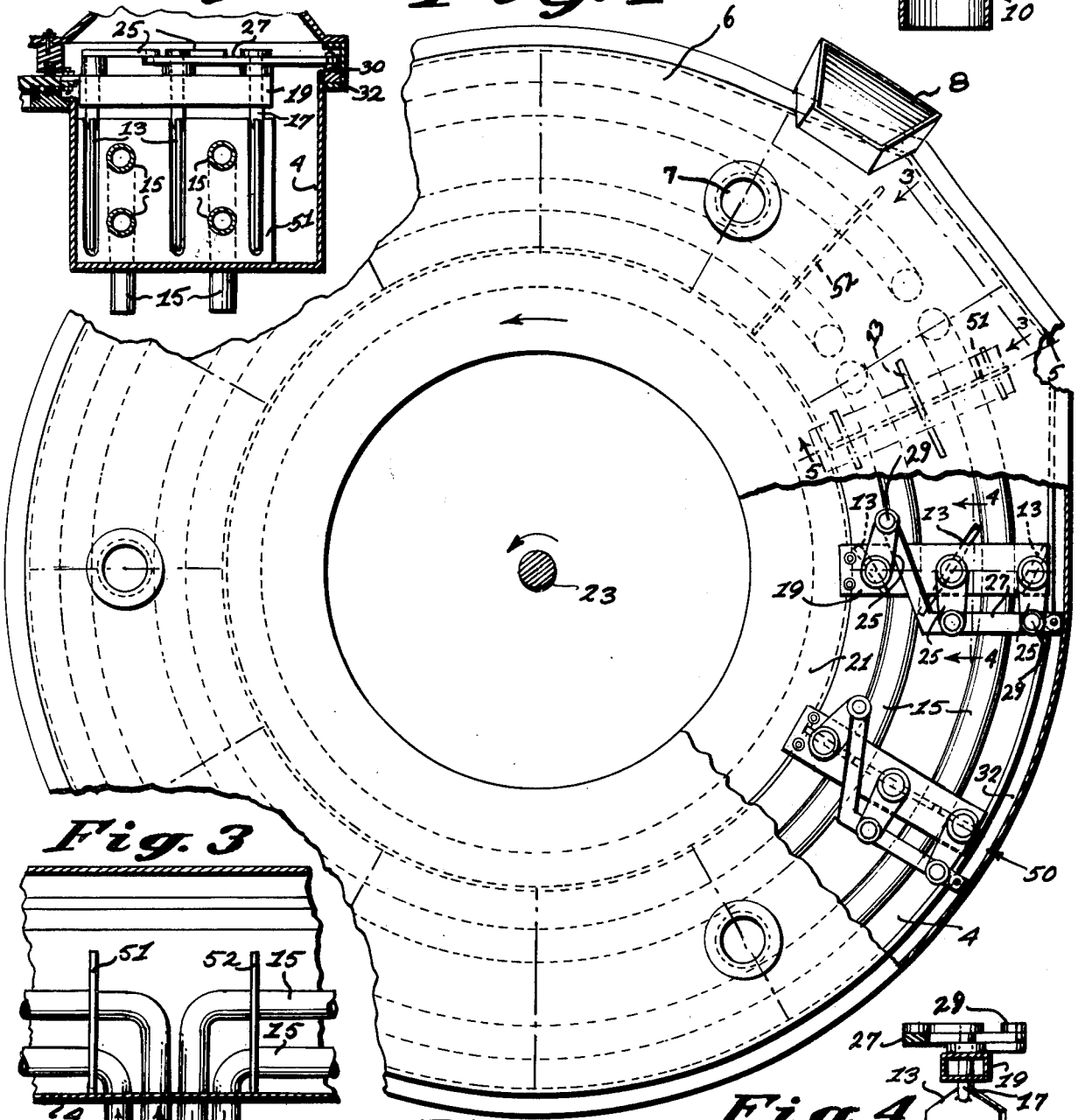
Fig. 3
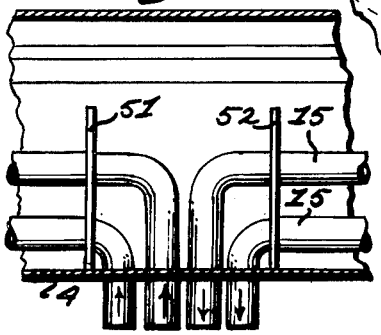
Fig. 2
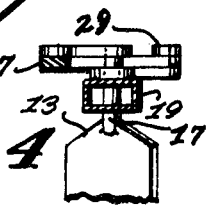
Fig. 4

CONTINUOUS PROCESS DRYER

Industrial drying machines of the prior art have been handicapped by a number of disadvantages, especially those effecting heat transfer to or from granular, powdered or other particulant material. One such problem is that the material being processed tends to stick to the surfaces to which it comes in contact. Another problem arises from the fact that joints in the heat transfer surfaces create problems especially where pharmaceutical or food products are involved, largely because weldments and other joints cannot be kept clean or free from leakage.

It is the object of this invention to eliminate these disadvantages by providing a continuous process heat transfer device where the heat energy source or sink is confined to tubular conductors which contain no joints and are exposed in the fabrication process only to simple rolling or bending operations.

A further object of the invention is to provide a heat transfer machine for granular or powder products where constant mixing is achieved by rake units which are not themselves heated or cooled and which rake units also provide scraping edges to prevent material from sticking to the heat transfer conductors or other surfaces.

Other and further objects, features and advantages of the invention will become apparent from a reading of the following description of a preferred form of the invention taken in conjunction with the accompanying drawings in which:

FIG. 1 is a side elevational view of the heat transfer device of the present invention with a portion thereof cut away and shown in cross-section.

FIG. 2 is a top plan view of the heat transfer device of the present invention with a portion thereof cut away and shown in cross-section.

FIG. 3 is a fragmentary cross-section of the drying trough showing the entry and exit of the heat transfer conduit.

FIG. 4 is a fragmentary and enlarged cross-sectional view taken along lines 4—4 in FIG. 2.

FIG. 5 is a fragmentary cross-sectional view taken along lines 5—5 of FIG. 2.

At the outset, it should be pointed out that although the invention will hereinafter be described as a drier, the nature of the construction of the device also permits its use as a heater or cooler, depending on the temperature of the fluid being pumped through the heat transfer conduits.

The preferred form of the drier 2 is depicted in FIGS. 1 and 2 wherein an annular trough 4 is provided for holding material to be treated. The trough 4 is enclosed by a cover member 6 which contains a plurality of openings 7 which may be connected by some convenient means for disposal of vapors, etc. The material is injected into the drying trough through the feed box 8.

At one point in the bottom of the annular trough, there is provided an opening where the treated material may be discharged through discharge box 10.

As will become clear as the description proceeds, the material which enters the drier through the feed box 8 is conveyed around the drying trough 4 by a set of paddles 13 which revolve around the central point of the annular trough. As the paddles 13 move around the trough they not only convey the material being processed but provide mixing at the same time.

Heat energy is supplied for the drying operation through the transfer of heat energy from a plurality of spaced apart conductor conduits 15. These conduits 15 enter the trough through the bottom surface thereof, as shown in FIG. 3 and trace a course around the trough and exit in close proximity to their point of entry. Heated or cooled fluid is circulated through these conduits 15 by a pump and from a source not shown on the drawings.

As seen in FIG. 1, the paddles 13 are substantially rectangular in shape and are relieved in semi-circular patterns along their sides to accommodate the conductor conduits 15. The spacing between the conduits 15 and the cut-outs in the paddles is largely a matter of choice, depending on the size of the particulants being treated and their proclivity for sticking to the conduit 15 or other surfaces. It is apparent that the paddles, as they rotate around the machine, will have a scraping action on the outside surface of the conduits and the walls of the trough. Decreased spacing between paddles 13 and conduit 15 and wall surfaces will increase the scraping efficiency.

Each of the paddles 13 is supported by a splindle 17 which is journalled for rotation in a mounting block 19. The mounting block 19 is secured to the periphery of a circular drive disc or turntable 21 which is attached at its center of rotation to a drive shaft 23 for providing rotating force. The motor which turns the drive shaft is not shown.

Fixed to the upper end of each of the mounting spindles 17 is a lever arm 25, each of which is rotatably secured to a tie rod 27 by pins 29. As the control arm is moved axially along its longitudinal axis, the lever arms 25 are simultaneously pivoted, resulting in rotation of the spindles 17 and the paddles 13. The rotation of the paddles is made necessary by the fact that the heat transfer conduits 15 are directed downwardly out of their normal plane in order to enter and exit from the trough 4, making clearance of the paddles impossible unless they are rotated to a position which does not create interference. In this position, the paddles pass through stationary partitions 51 and 52 that provide scraping of the paddles 13 before they re-enter the next raking cycle.

The necessary rotation of the paddles is provided by cam action created by a cam roller 30 attached to the end of the tie rod 27. The cam roller is disposed within a track 32 attached to the outside periphery of the trough 4 except along a short length thereof which is radially aligned with the entry and exit positions of the conduits 15. Along this length, the track is extended outwardly and away from the periphery of the trough 4 in order to create a radially outward movement of the cam roller as it traverses the track 32. As the cam roller 30 moves radially outward, the tie rod 27 is likewise moved longitudinally causing rotation of the paddles 13. This rotation is to the extent and for the time necessary to clear all portions of the conduits 15. The paddles are returned to their normal angles as the cam roller 30 follows the track inwardly to the periphery of the trough.

To maintain a tight seal between the rotating turntable, the cover 6 and the trough 4, upper and lower seal rings 34 and 35 are provided. The top seal ring 34 is carried by the annular depending lip 37 of the cover 6. The lower seal 35 is likewise carried by a flange 39 attached to the inside wall of the trough 4. Low friction bearing surfaces 41 and 42 are also mounted on the upper lip 37 and the lower flange 39 respectively.

In operation, the structure described above is one which lends itself to many modifications. Depending on the application and use of the machine, more than one set of paddles can be employed. For example, in FIG. 2 shown by reference number 50, a second set of paddles is indicated to intensify the raking and mixing of the material within the trough 4. Other cam tracks can also be provided so as to rotate the paddles to facilitate proper discharge of the materials. Furthermore, the trough need not be circular in shape. It may, for example, be of straight configuration with the paddles mounted on an endless conveyor track above the trough and provided with the same caming action for the rotation of the paddles to clear the conduits as the paddles enter and leave the trough.

I claim:

1. A heat transfer system for particulant material comprising:

A trough for placement of the material;

a plurality of spaced apart mutually parallel conduits disposed within the trough at a constant distance from the sides thereof, a source of controlled temperature fluid;

means interconnecting the conduits to the source of fluid and forming a circulating path;

mixing means including a plurality of paddles depending into said trough in close proximity to said conduits;

drive means for moving said paddles along the trough, including means rotatably mounting the paddles for rotation about an axis perpendicular to the direction of paddle travel;

cam means including a cam surface operatively connected to the trough and cam follower means;

tie means interconnecting the cam follower and the means rotatably mounting the paddles.

2. The combination of claim 1 and further including filling and discharge means in said trough.

3. The combination of claim 1 wherein each of said paddles includes relieved areas for accommodation of a portion of the said conduits.

4. The combination of claim 3 and further including at least one scraper upstanding from the bottom of the trough and having a plurality of openings through which the paddles may pass.

5. The combination of claim 4 wherein each of the said conduits enter and exit from the trough at an angle to the bottom of the trough and within a planar surface generated by the conduit as it is disposed within the trough.

6. The combination of claim 5 wherein the cam surface is parallel to at least a portion of the said conduits and having non-parallel portions on both sides of the area of the trough at which the conduits enter and exit.

7. The combination of claim 6 wherein the said non-parallel portions of the cam surface are sized and arranged so that the surface of the said rotatably mounted paddles are substantially parallel with the planar surface generated by the conduits at and between the points at which the conduits enter and exit the trough.

8. The combination of claim 7 wherein the said scraper is disposed within the trough at a point where the surfaces of the said paddles are disposed substantially parallel to the planar surface generated by the conduits.

* * * * *